US007748534B2

(12) United States Patent
Jeannin et al.

(10) Patent No.: US 7,748,534 B2
(45) Date of Patent: Jul. 6, 2010

(54) PACKAGE FOR GOODS

(75) Inventors: Lionel Jeannin, Choisy (FR); Marco Ackermann, Conches (CH)

(73) Assignee: Novartis AG (CH)

( * ) Notice: Subject to any disclaimer, the term of this patent is extended or adjusted under 35 U.S.C. 154(b) by 150 days.

(21) Appl. No.: 11/921,145

(22) PCT Filed: May 11, 2006

(86) PCT No.: PCT/EP2006/004431

§ 371 (c)(1),
(2), (4) Date: Nov. 26, 2007

(87) PCT Pub. No.: WO2006/119992

PCT Pub. Date: Nov. 16, 2006

(65) Prior Publication Data

US 2009/0134053 A1 May 28, 2009

(30) Foreign Application Priority Data

May 13, 2005 (EP) ..... 05010449

(51) Int. Cl.
*B65D 83/04* (2006.01)

(52) U.S. Cl. ..... 206/528; 206/531; 206/532; 206/538

(58) Field of Classification Search ..... 206/528, 206/531, 532, 538, 539, 311, 469, 470, 800; 229/125.125
See application file for complete search history.

(56) References Cited

U.S. PATENT DOCUMENTS 4,450,965 A * 5/1984 Paillet ..... 206/528
4,974,729 A * 12/1990 Steinnagel ..... 206/531
5,624,036 A 4/1997 Roulin et al.
6,024,222 A * 2/2000 Friberg et al. ..... 206/531
6,253,920 B1 7/2001 Kallgren (Continued)

FOREIGN PATENT DOCUMENTS

CA 2352428 A1 6/2000

(Continued)

OTHER PUBLICATIONS

English Language Abstract and Computer-Generated English Translation of DE 19855318(C1).

*Primary Examiner*—David T Fidei
(74) *Attorney, Agent, or Firm*—Diane E. Furman

(57) ABSTRACT

A package comprises an outer package (2) having two members (20, 21) connected to one another via a flexible web portion (22). Each member (20, 21) comprises a base panel (200, 210) and two opposite side wall panels (201, 202, 211, 212). One of the side wall panels (201, 211) has an attachment (204, 214) portion extending towards the opposite side wall panel (202, 212). An inner package comprises blister pack members (3) comprising an edge portion (304, 314) attached to the attachment portion (204,214) of the outer package member (20, 21) such, that in a closed state the goods carried by the blister pack member are facing towards the base panel (200,210). The members (20,21) are folded towards each other via the flexible web portion (22). In an open state the outer package members (20, 21) are unfolded and the members (3) can be accessed by folding the blister pack member (30, 31) away from the opposite side (202, 212) wall panel.

10 Claims, 10 Drawing Sheets

U.S. PATENT DOCUMENTS

| | | | | |
|---|---|---|---|---|
| 6,951,282 | B2 * | 10/2005 | Jones | 206/469 |
| 7,025,207 | B2 * | 4/2006 | Breu et al. | 206/531 |
| 2004/0026293 | A1 | 2/2004 | Hughes | |
| 2004/0050748 | A1 * | 3/2004 | Ehrlund | 206/538 |
| 2005/0035023 | A1 * | 2/2005 | Breu et al. | 206/531 |
| 2005/0051459 | A1 | 3/2005 | Casanova | |
| 2005/0126949 | A1 * | 6/2005 | Maffei | 206/459.1 |
| 2005/0173291 | A1 * | 8/2005 | Specker et al. | 206/536 |
| 2005/0274643 | A1 * | 12/2005 | Arnold | 206/531 |
| 2006/0081495 | A1 * | 4/2006 | Killinger | 206/532 |
| 2006/0138014 | A1 * | 6/2006 | Drought et al. | 206/528 |

FOREIGN PATENT DOCUMENTS

| | | | |
|---|---|---|---|
| DE | 3838144 | A1 * | 5/1990 |
| WO | WO9316673 | | 9/1993 |
| WO | WO03010065 | | 2/2003 |

* cited by examiner

PACKAGE FOR GOODS

This invention deals with a package for goods according to the preamble of the independent patent claim.

BACKGROUND OF THE INVENTION

Blister packs for drugs in tablet form or in the form of powder or liquid contained in a capsule have been known for a long time. Usually, a blister pack comprises a relatively rigid base foil, and a lid foil, which are attached to one another. The base foil comprises cavities or open blisters for accommodating a tablet or capsule, while the lid foil is flat and seals the opening of the cavities or blisters. The most common way of attaching the foils to one another is heat sealing. Accordingly, at least one of the foils typically has thermoplastic properties. Examples of materials for the base foil are aluminum laminate, polypropylene or PVC-laminates. Examples of materials for the lid foil are aluminum or aluminum laminates, etc.

One or more blister packs are usually placed in an outer package, such as a box or a carton, and the units sold at the pharmacies typically comprise an outer package (the box or carton), that contains one or more inner packages (one or more blister packs) and typically instructions as to administration, side effects, etc. In order to save volume in the outer package, it has been suggested in U.S. Pat. No. 6,253,920 to provide a blister pack that comprises two parallel rows of blisters connected by a flexible web. The blisters of one row are offset relative to the blisters of the respective other row, so that upon folding the blister along the flexible web the blisters of one row come to lie in the space between the blisters of the respective other row, with the lid foils of adjacently arranged blister packs facing each other.

However, a single blister pack taken out of the package for being carried along is prone to damage, since the vulnerable lid foil faces outwardly. Therefore, it has been the usual way to carry the whole package (outer package containing one or more blister packs) along, which is quite inconvenient. In addition, the process of pulling a blister pack out of the outer package is also comparatively inconvenient. It is therefore an object of the invention to overcome the afore-mentioned disadvantages.

SUMMARY OF THE INVENTION

To overcome these inconveniencies according to the invention a package for goods is suggested, as it is characterized by the features of the independent patent claim. Advantageous embodiments are the subject of the dependent claims.

The general concept underlying the instant invention is, that the products are better protected against unintentional access. Therefore, in case the inner package is a blister pack, the lid foil of one of the blister pack members comes to lie on the lid foil of the other blister pack member. This provides additional protection for the products, since the lid foils cannot easily be damaged unintentionally. However, even if the inner package simply comprises panel members rather than blister pack members, the products are carried by the panel members such that they face the comparatively rigid base panel of the outer package and are thus better protected against unintentional access.

In particular, a package for goods, e.g. chewing gums, tablets, capsules or the like, is suggested which comprises a closeable and openable outer package as well as an inner package carrying the goods. The outer package comprises two comparatively rigid outer package members which are connected to one another via a flexible web portion. Each of the two outer package members comprises a base panel and two opposite side wall panels. At least one of the side wall panels of each of the two outer package members is provided with a fold so as to form an attachment portion extending in a direction towards the opposite side wall panel of the respective outer package member. The inner package comprises panel members or blister pack members carrying the goods on one of its two sides. The panel members or blister pack members of the inner package comprise an edge portion which is attached to the attachment portion of the respective outer package member such, that in a closed state of the package the goods carried by the respective panel member or blister pack member are facing towards the base panel of the respective outer package member, and the two outer package members are folded towards each other via the flexible web portion so as to lie one above the other. In an open state of the package the two outer package members are unfolded and the panel members or blister pack members carrying the goods can be accessed by folding the attachment portion with the attached panel member or blister pack member in a direction away from the opposite side wall panel thus exposing the goods carried by the panel or blister pack.

While it is preferred that the inner package comprises blister pack members, this is not mandatory, since even in the case of panel members the goods are carried such that they face the base panel of the outer package and are thus protected against unintentional access. When the outer package has been opened, the attachment portion with the attached panel members or blister pack members that carry the products can be folded outwardly so as to expose the products. This can be done individually for each of the panel members or blister pack members as long as these members are not connected to each other.

In one embodiment of the package according to the invention the outer package members further comprise front wall panels having engagement means allowing to lock the outer package members in the closed state and to release them again. This provides additional protection against unintentional access, since first of all the engagement means must be released in order to allow access to the inner space of the outer package at all.

In a further embodiment of the package according to the instant invention the inner package comprises two panel members or blister pack members which are connected by a flexible fold. The edge of the panel members or blister pack members are attached to the attachment portion of the outer package members with the flexible web portion between the outer package members being bulged. As a consequence, due to the attachment of the blister pack members only along the attachment portion of the outer package, during unfolding of the outer package members the two panel members or blister pack members are unfolded and additionally flipped to a position where they expose the goods. This embodiment is extraordinarily convenient since the user does not have to fold the attachment portion with the attached panel member or blister pack member outwardly so as to get access to the product, but rather this operation is performed "automatically" while opening the outer package.

In a still further embodiment of the package according to the instant invention, the flexible fold connecting the two panel members or blister pack members is formed by an elongated groove that extends over a substantial part of the width of the connected panel members or blister pack members. Slits are arranged in axial alignment with the elongated groove, with one slit extending from the respective edge of the panel member of blister pack member towards the elongated groove so as to define the hinge axis which the connected panel members or blister pack members are folded about. While the elongated groove provides for good flexibility of the hinge it does not—taken alone—precisely determine the hinge axis which the panel members or blister pack members are folded about. This hinge axis, however, is set by the precut slits while at the same time the good flexibility of the hinge is maintained. It is also evident, that this embodiment is easy to manufacture.

In still a further embodiment of the package according to the invention, those side wall panels of the outer package members opposite the side wall panels having the attachment portions are provided with a wall extension which is triangularly folded so as to angularly extend towards the base panel, the wall extension then being again folded to as to run parallel to the base panel. This folding technique minimizes the overall size of the packaging and provides much a package having improved rigidity when compared to a square folded end.

In a specific embodiment of the package according to the invention, the wall extension is provided with a flap. This embodiment improves rigidity of the side wall, as will be explained further below. Further advantageous aspects of the invention will become clear when reading through the following detailed description of embodiments of the invention with the aid of the drawings, in which:

DETAILED DESCRIPTION

Figure 1:
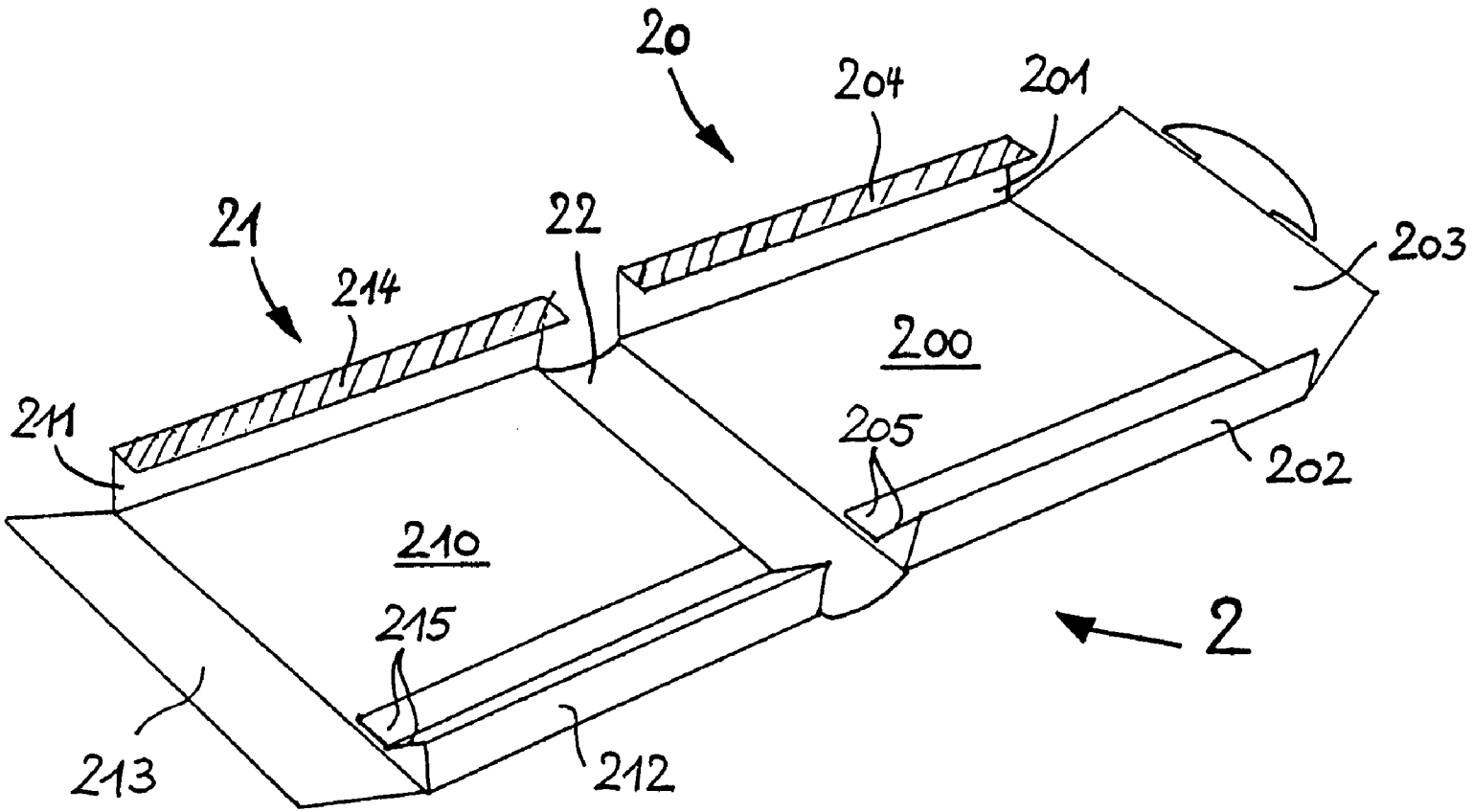
FIG. 1 shows the outer package of an embodiment of the package according to the instant invention in the open state

In FIG. 1 an outer package 2 of one embodiment of the package according to the invention is shown. Outer package 2 is shown in the open state, i.e. unfolded. It comprises two outer package members, a first outer package member 20 and a second outer package member 21, which are connected to one another via a flexible web portion 22. First outer package member 20 comprises a base panel 200, two opposite side wall panels 201 and 202, and a front wall panel 203. Likewise, second outer package member 21 comprises a base panel 210, two opposite side wall panels 211 and 212, and a front wall panel 213.

Side wall panel 201 of the first outer package member 20 is provided with a fold so as to form an attachment portion 204 that extends in a direction towards the opposite side wall panel 202. Side wall panel 202 is provided with a wall extension 205 which is triangularly folded, extends towards base panel 200, and is then again folded so as to run parallel to base panel 200. A thus configured side wall panel 202 improves stability of outer package 2. Likewise, side wall panel 211 of second outer package member 21 is provided with a fold so as to form an attachment portion 214 that extends in a direction towards the opposite side wall panel 212. Side wall panel 212 is provided with a wall extension 215 which is triangularly folded, extends towards base panel 210, and is then again folded so as to run parallel to base panel 210.

Figure 10:
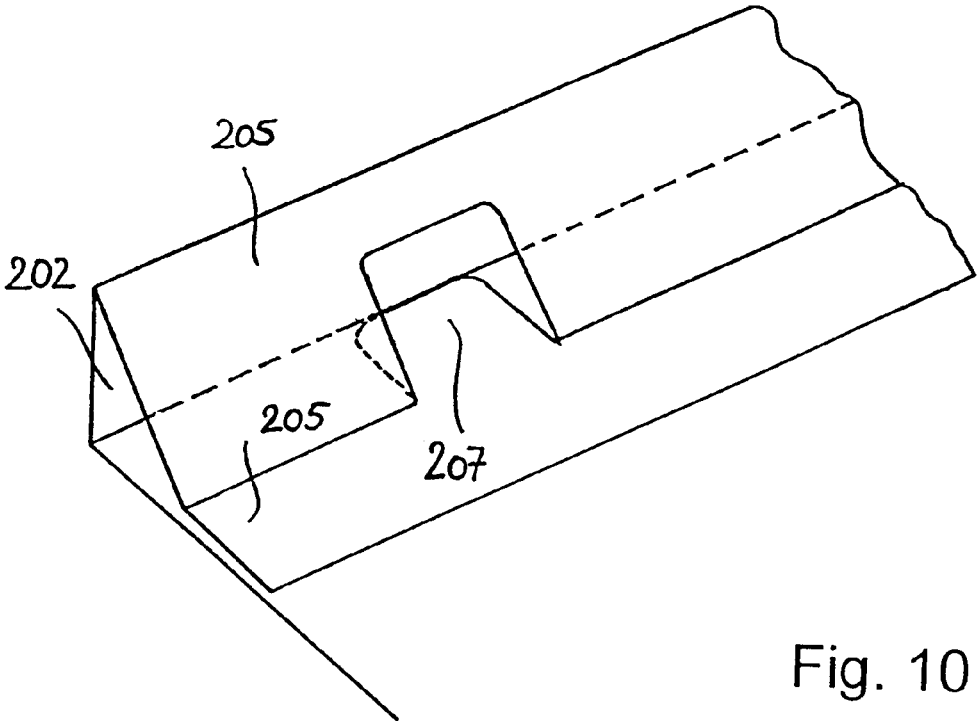
FIG. 10 shows a perspective view of an embodiment of a triangularly folded side wall panel of the outer package
Figure 12:
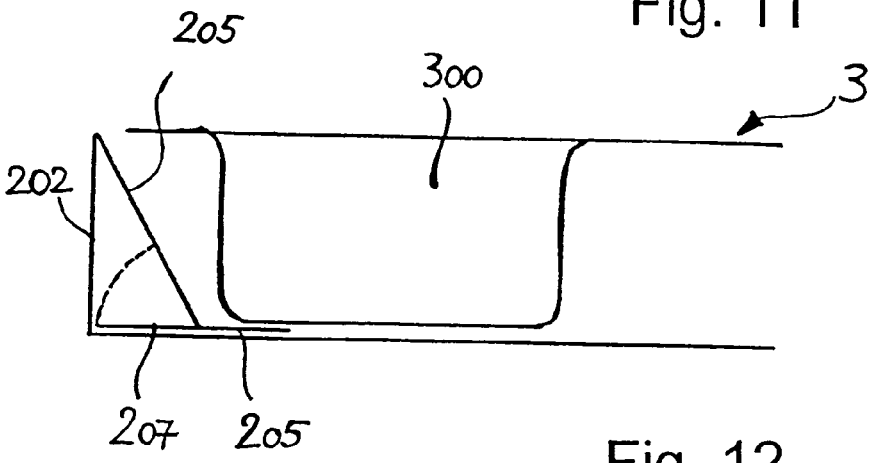
FIG. 12 shows in a side view the triangularly folded side wall panel of FIG. 10

One embodiment of a side wall panel 202 that is provided with a triangularly folded wall extension 205 is shown in perspective in FIG. 10 and in FIG. 12, respectively. Triangularly folded wall extension 205 is provided with a flap 207. Flap 207 may be bent down to base panel 200 and may be glued to base panel 200 in a position where it abuts against side wall panel 202, as shown in FIG. 10. Also, the part of wall extension 205 that runs parallel to base panel 200 is glued to base panel 200. Flap 207 assists in glueing flap 207 and the lower portion of wall extension 205 to base panel 205 in the proper position, so that a rectangular triangle is formed (see FIG. 12). At the same time flap 207 increases the bonding area. Using such a triangularly folded wall extension, no outer package deformation may occur and the overall package size is optimized as well.

Figure 11:
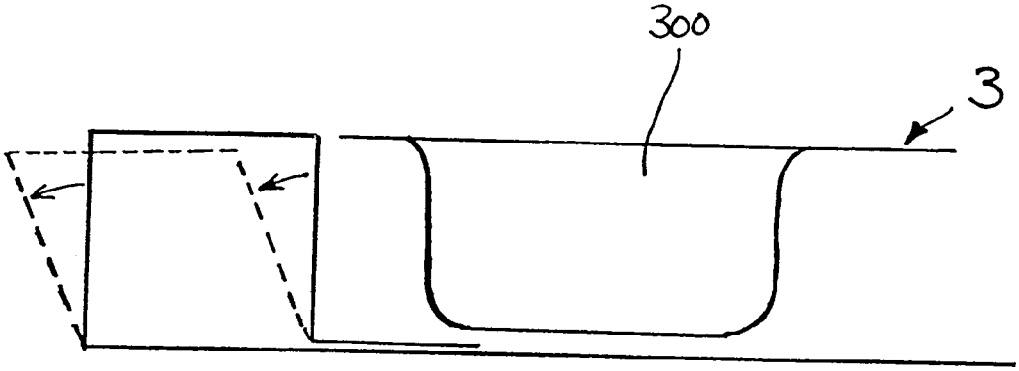
FIG. 11 shows in a side view a square-folded side wall panel of the outer package

This can be immediately recognized when glancing at the embodiment of a square-folded wall extension of the side wall panel, as shown in FIG. 11. Even if the lower portion of the wall extension is glued to the base panel, a deformation of the side wall and the square-folded wall extension may occur so as to form a non-rectangular parallelogram, as this is indicated by the dashed lines in FIG. 11. Such deformation is not possible when using the triangularly folded wall extension as shown in FIG. 10 and FIG. 12, respectively. Accordingly, the triangularly folded wall extension 205 also improves rigidity of outer package 2.

Figure 2:
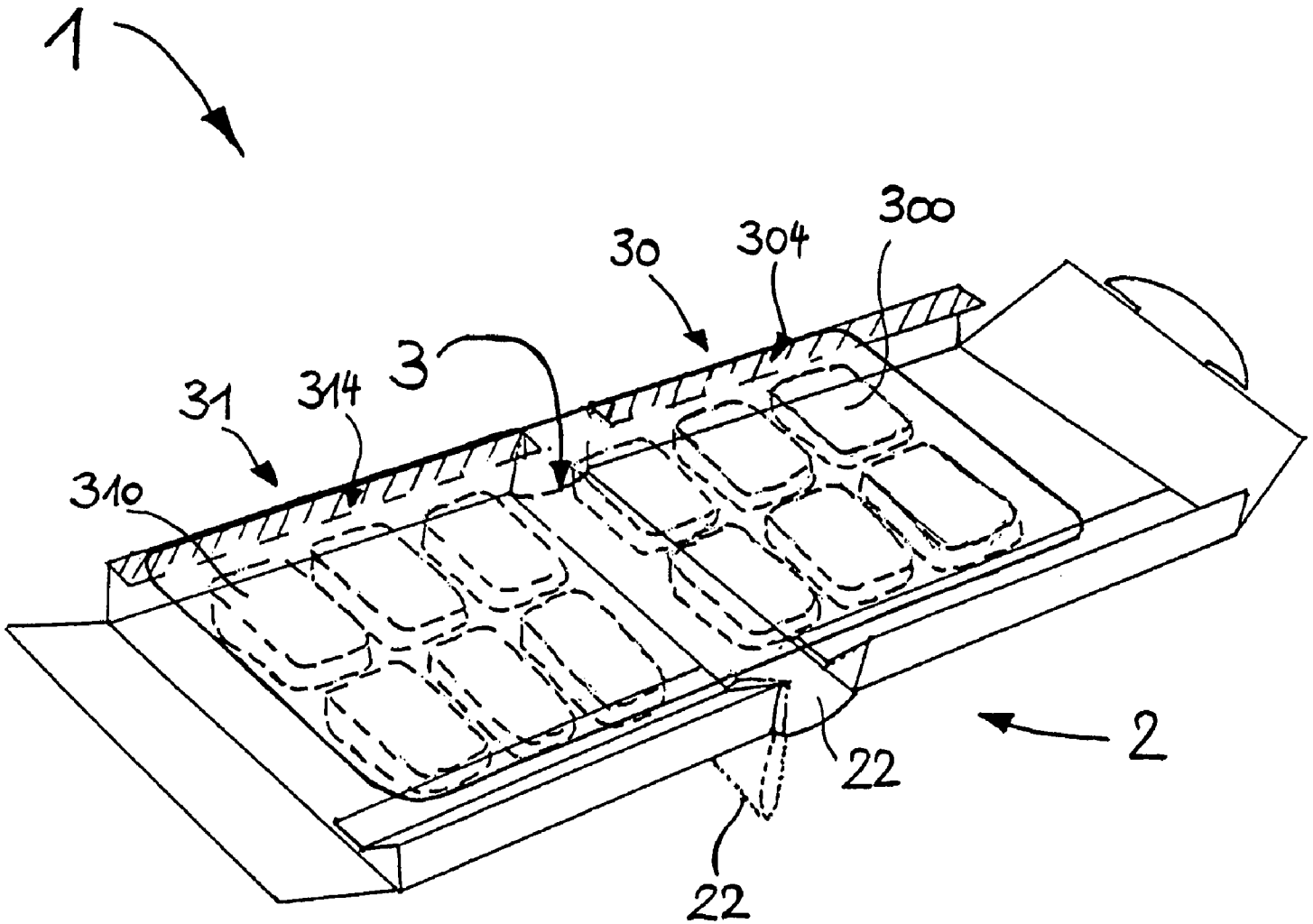
FIG. 2 shows an embodiment of the package according to the instant invention, with an outer package of FIG. 1 and an inner blister pack being attached to the attachment portion of the side wall of the outer package
Figure 5:
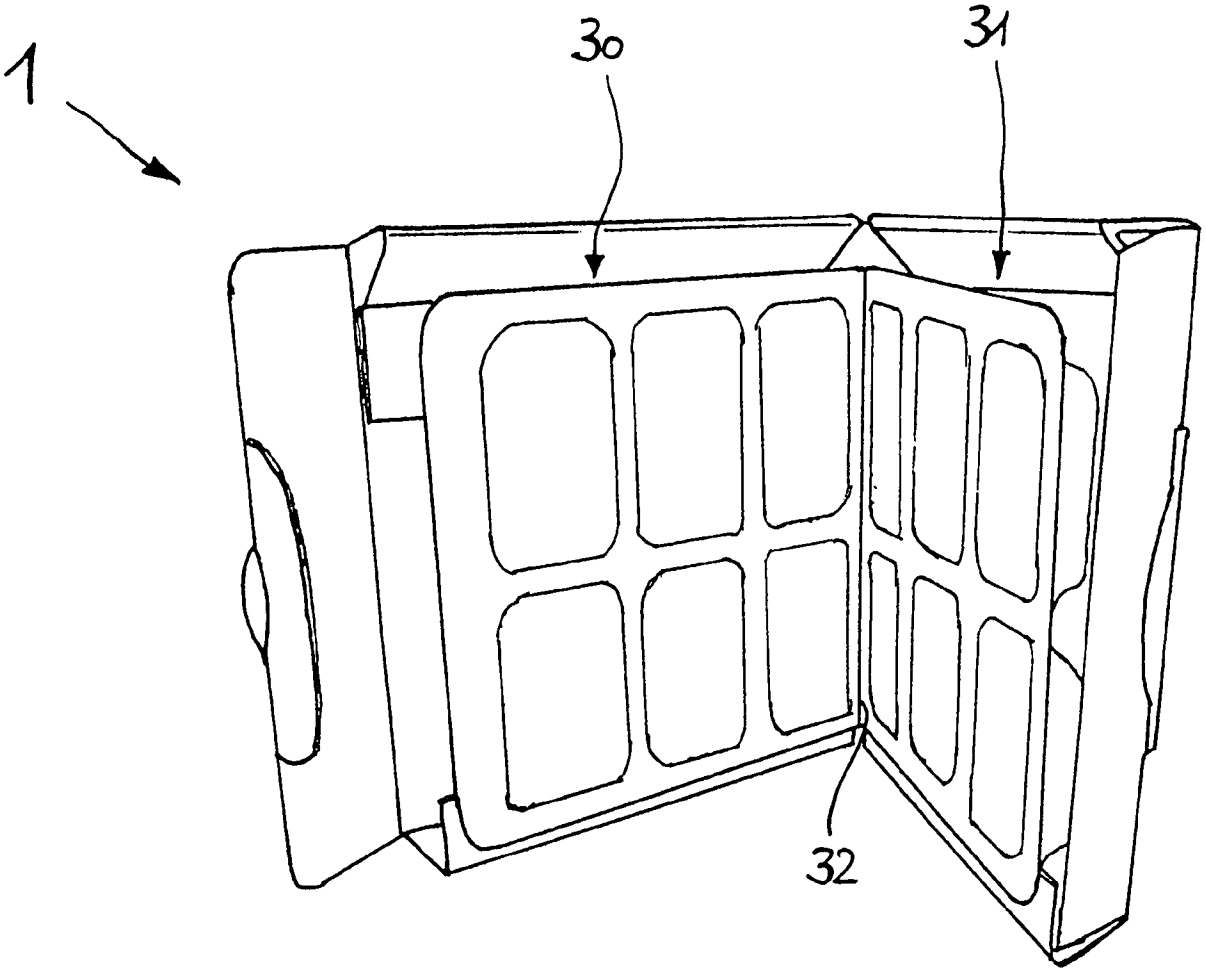
FIG. 5 shows the embodiment of the package of FIG. 2 just at the beginning of unfolding the package

FIG. 2 shows an embodiment of the package 1 according to the instant invention comprising an outer package 2, as it has been described by way of example with reference to FIG. 1, and an inner package, which in the embodiment shown here is a blister pack 3 comprising two blister pack members, a first blister pack member 30 and a second blister pack member 31 which are connected to one another by a flexible fold 32 (not shown in FIG. 2, see FIG. 5). The single blisters 300 and 310 of the blister pack members 30 and 31, respectively, are facing towards the respective base panels 200 and 210 of outer package members 20 and 21, as this is indicated in FIG. 2 by dashed lines. That is to say, the comparatively rigid (and in some instances transparent) base foils of blister pack members 30 and 31, respectively, face towards the respective base panels 200 and 210 of outer package members 20 and 21, while the more flexible lid foils (typically aluminum foils) are facing upwardly in FIG. 2. It is to be noted, that the inner package does not necessarily have to be a blister pack— although a blister pack is a preferred embodiment of an inner package, it is very well conceivable to use flat panel members carrying the products on their upper or lower side instead of blister panels, depending on the type of products they carry. Also, the inner package members (blister pack members or panel members) do not necessarily have to be connected to one another—they can also be separate members, with each member being attached to one of the attachment portions of the outer package members. However, the embodiment shown with the blister pack members 30 and 31 being connected by flexible fold 32 are particularly advantageous, as will be explained in further detail below.

Blister pack members 30 and 31 of blister pack 3 have edge portions 304 and 314, respectively, which are attached to attachment portions 204 and 214 of the respective outer package members 20 and 21. Edge portions 304 and 314 of blister pack 3 are attached to attachment portions 204 and 214 (see FIG. 1) with attachment portions 204 and 14 having been moved towards each other, so that the flexible web portion 22 is bulged, as this is indicated by phantom lines in FIG. 2. Attachment of edge portions 304 and 314 to attachment portions 204 and 214 can be performed by any suitable technique, such as sealing, glueing, etc.

Figure 3:
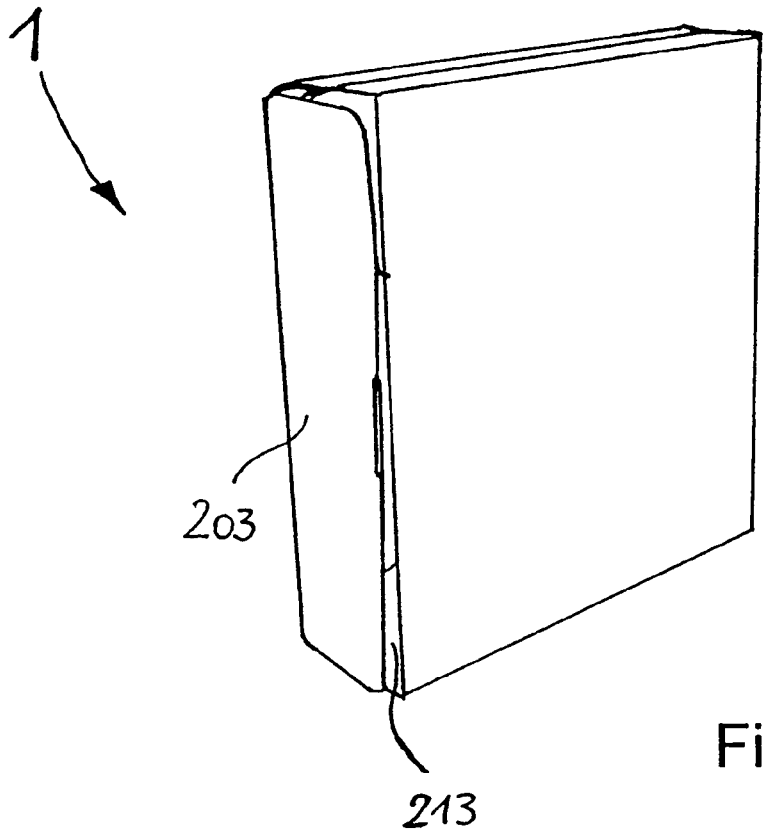
FIG. 3 shows the embodiment of the package of FIG. 2 in the closed state, with locked engagement means

Once edge portions 304 and 314 of blister pack 3 are safely attached to attachment portions 204 and 214 of outer package 2, the package 1 can be closed and "locked" in the closed state. This locked closed state of package 1 is shown in FIG. 3. From FIG. 4 it can be seen, that the package can be locked with the aid of engagement means that are provided at front panels 203 and 213, respectively. In the shown embodiment of the package, the engagement means comprise a tongue 206 provided at front panel 203 of outer package member 20 and a corresponding slit 216 provided at front panel 213 for accommodating tongue 206 so as to retain package 1 in the locked state. In the locked state, the aluminum lid foils of the blister pack members 30 and 31 are arranged to lie one above the other, and the blister pack is excellently protected against unintentional damaging of the lid foil.

Figure 4:
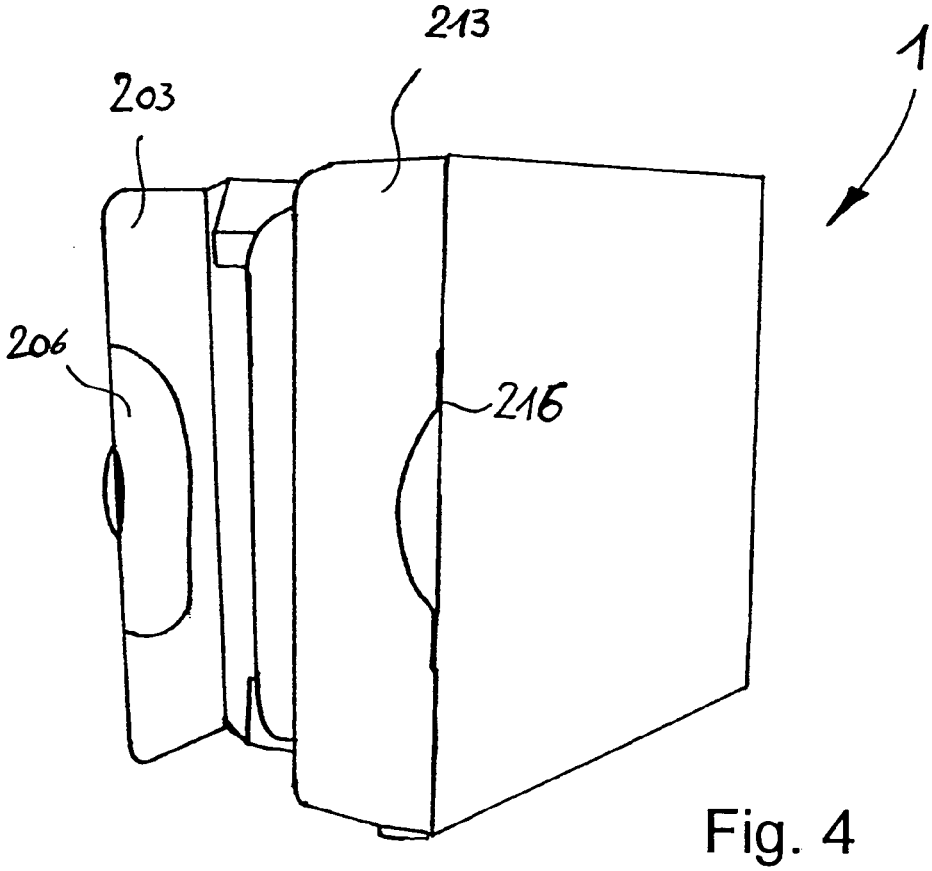
FIG. 4 shows the embodiment of the package of FIG. 2 in the closed state, with unlocked engagement means
Figure 6:
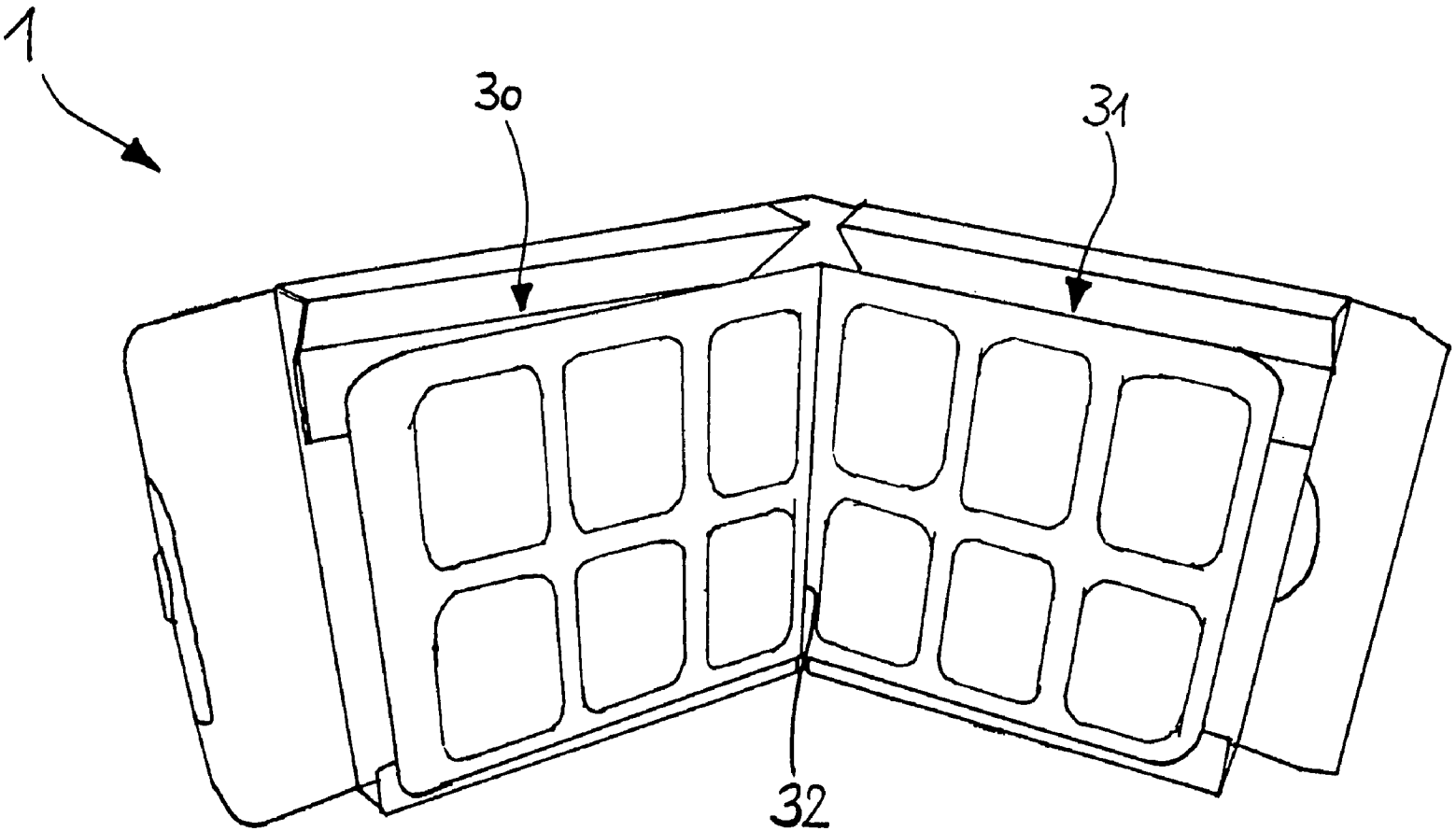
FIG. 6 shows the embodiment of the package of FIG. 2 during continuation of unfolding the package

With reference to FIGS. 4-9 the process of opening the package 1 for getting access to the products will now be described. In FIG. 4 the first step is shown: Tongue 206 being provided at front panel 203 has been pulled out of slit 216 provided in front panel 213. Package 1 can then be opened by unfolding it, as this is shown in FIG. 5 at the beginning of the unfolding process. As regards the blister pack 3, blister pack member 30 and 31 of the blister pack 3 are unfolded about flexible fold 32. This unfolding process is continued as shown in FIG. 6.

Figure 7:
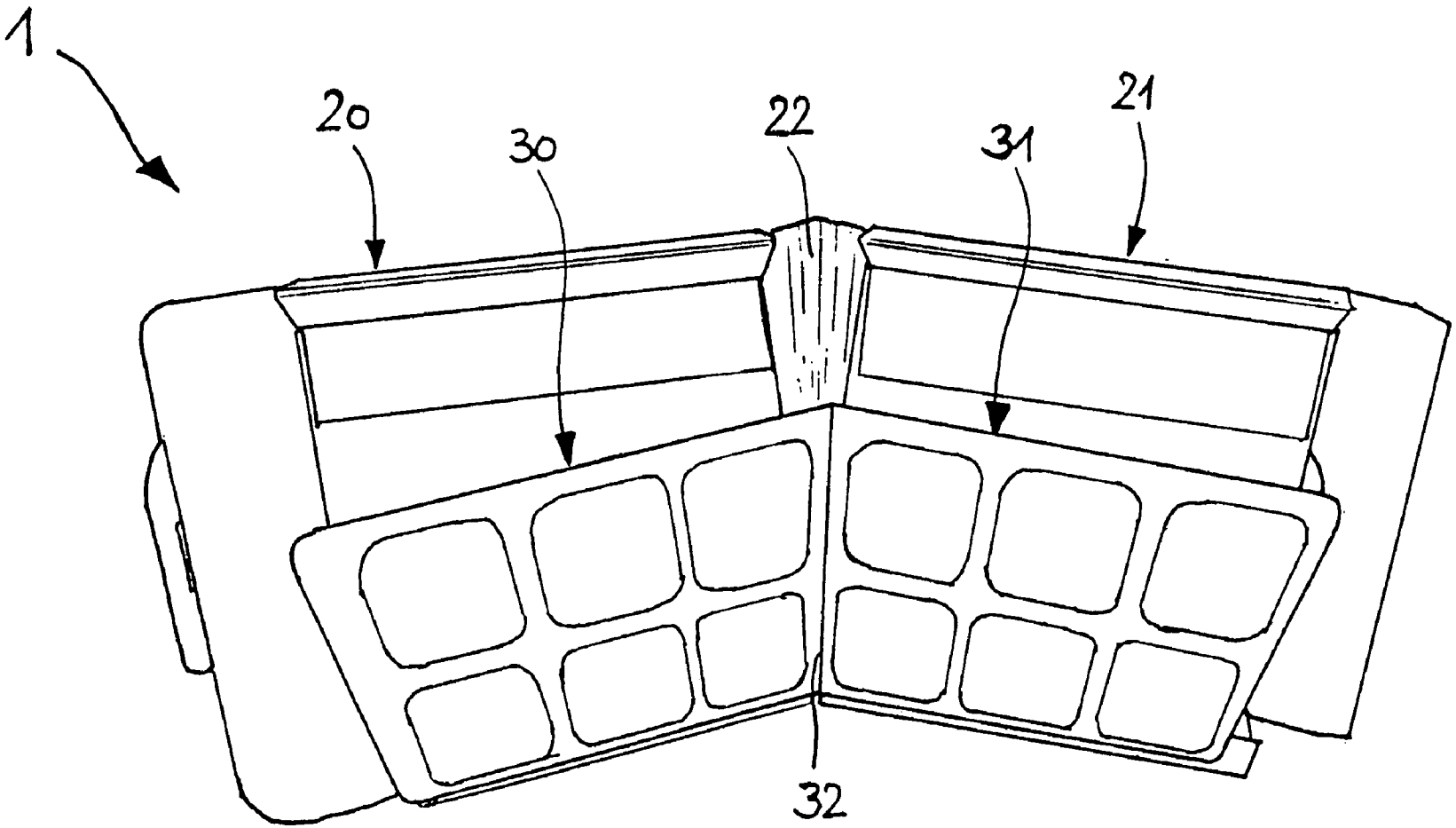
FIG. 7 shows the embodiment of the package of FIG. 2 after further continuation of unfolding the package, with the inner blister pack just beginning to flip downwardly
Figure 8:
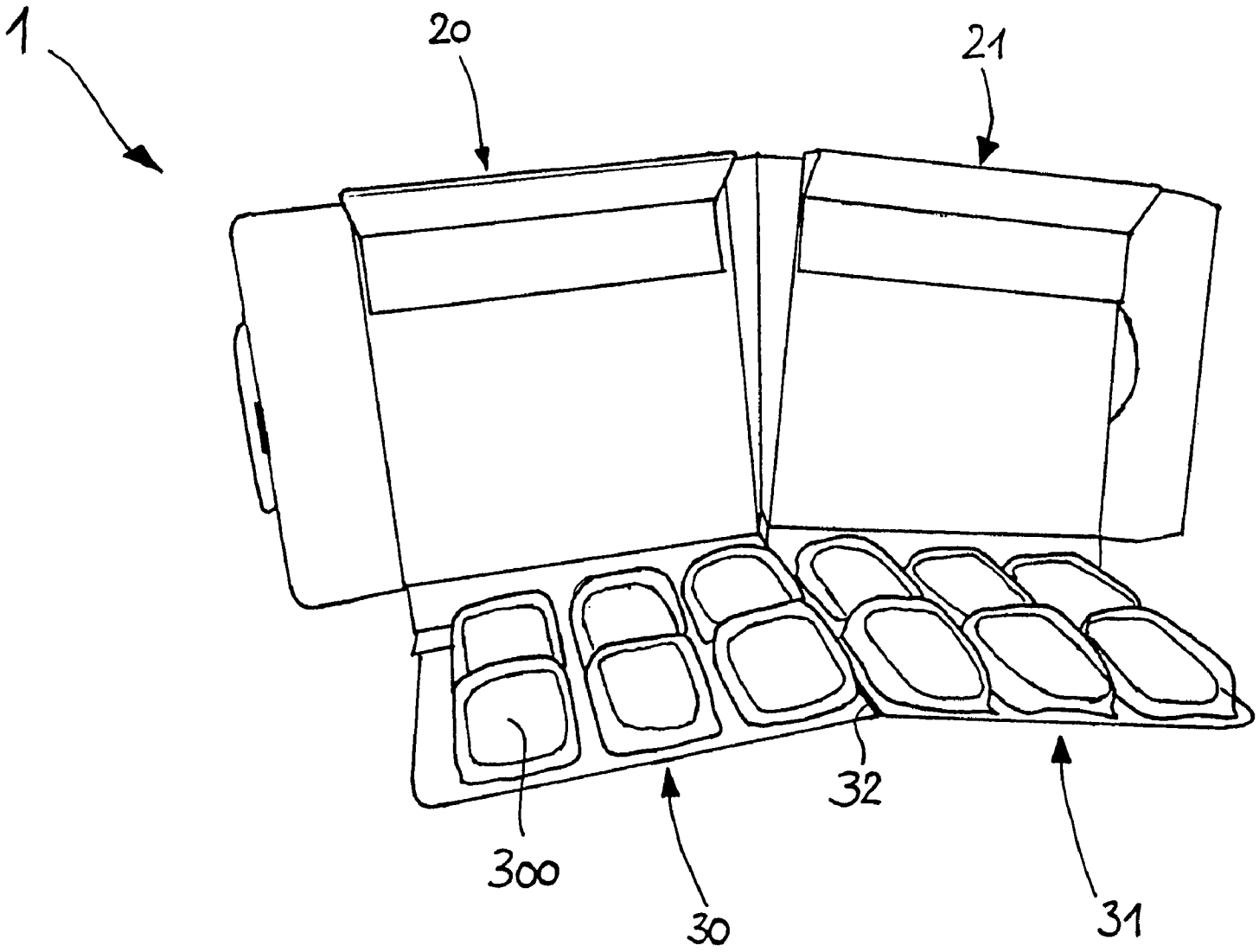
FIG. 8 shows the embodiment of the package of FIG. 2 again after further continuation of unfolding the package, with the inner blister pack continuing to flip downwardly.
Figure 9:
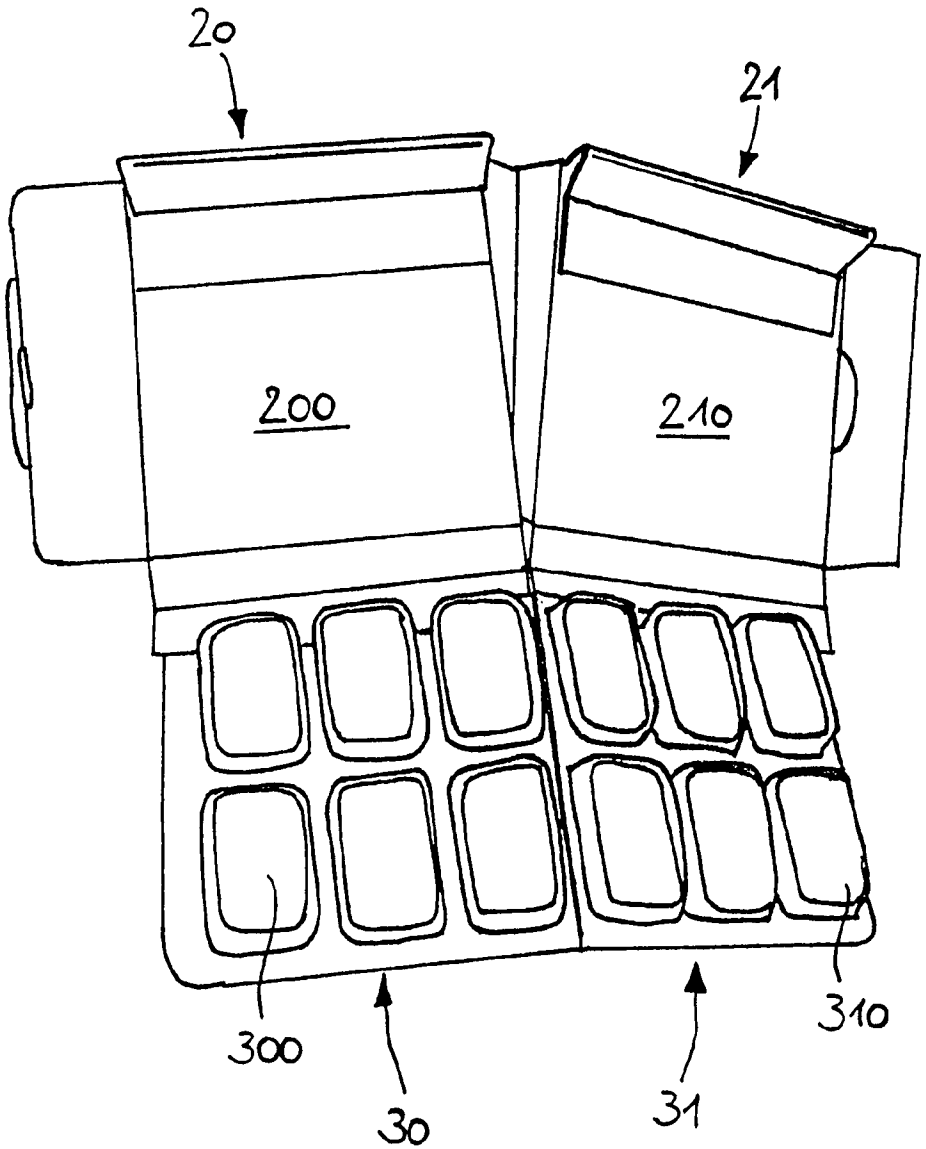
FIG. 9 shows the embodiment of the package of FIG. 2 in the fully unfolded state with the inner blister pack being completely flipped downwards

An additional effect that sets in during further continuation of the unfolding process will now be discussed with reference to FIGS. 7-9. This effect occurs due to the fact that flexible web 22 connecting first outer package member 20 and second outer package member 21 can be stretched in the longitudinal direction of package 1. However, due to the fact that first blister pack member 30 and second blister pack member 31 are connected via fold 32, which can essentially not be stretched in the longitudinal direction of package 1, flexible web 22 of outer package 2 cannot be stretched in the longitudinal direction either in the region where edge portions 304 and 314 of blister pack member 3 are attached to attachment portions 204 and 214 of outer package 2. As a consequence, due to being unable to follow the continued stretching of outer package 2, blister pack 3 starts to flip downwardly. This situation, in which blister pack 3 just starts the flipping movement, is shown in FIG. 7. Upon continuing the opening process, blister pack 3 further flips downwardly as shown in FIG. 8 until the package finally reaches the fully open position with blister pack 3 completely having flipped downwardly, as shown in FIG. 9. The base foil of single blisters 300 and 310 is now accessible, and a tablet or capsule can be taken out by pressing on the base foil of one of the blisters 300 or 310, respectively, resulting in creation of a tear in the aluminum lid foil, as this is conventional with blister packs. After having taken out the tablet or capsule, blister pack 3 can be returned to its original position (see FIG. 2) and outer package 2 can then be closed and "locked" again (see FIG. 3), so that it can be easily carried along with the aluminum lid foils of the blister packs 3 lying one above the other and the blisters facing base panels 200 and 210 of outer package 2, thus minimizing the risk of accidental damage to the aluminum lid foils of blister pack 3.

Figure 13:
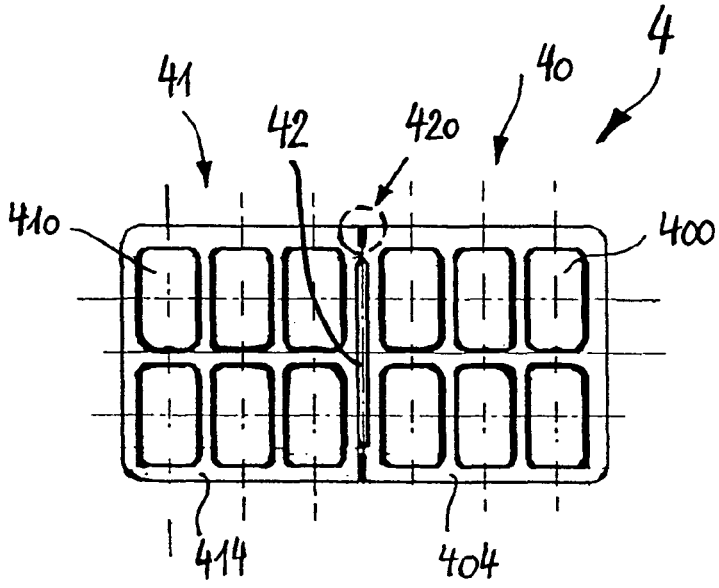
FIG. 13 shows a top view of a specific embodiment of a blister pack particularly suitable for use in the package according to the instant invention
Figure 14:
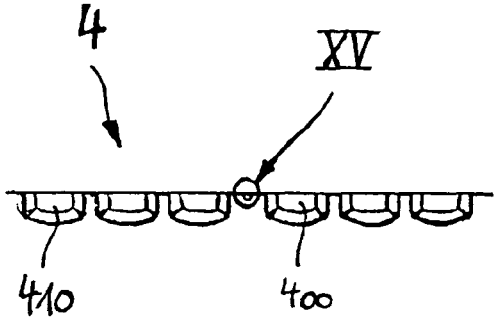
FIG. 14 shows a side view of the blister pack of FIG. 13.
Figure 15:
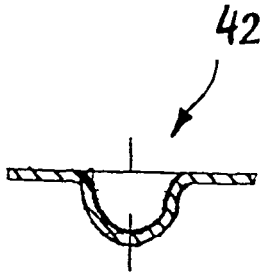
FIG. 15 shows the detail (elongated groove) indicated in FIG. 14 in cross-section.

Another embodiment of a blister pack which is particularly suitable as inner package of the package according to the instant invention is shown in FIG. 13. This embodiment of the blister pack 4 comprises two blister pack members 40 and 41 (much like blister pack members 30 and 31 of the embodiment of the package described above) having blister cavities 400,410 and edge portions 404,414 for attachment to the attachment portions 204,214 of outer package 2. However, the fold of blister pack 4 is formed by an elongated groove 42 extending over a substantial part of the width of the connected blister pack members 40,41. In axial alignment with elongated groove 42 slits 420 are arranged at both ends of elongated groove 42. The respective slit 420 extends (perpendicularly) from the respective edge of the panel member or blister pack member 40,41 towards elongated groove 42. Since elongated groove 42 has a certain width perpendicular to its longitudinal extension, elongated groove 42 taken alone does not precisely define the hinge axis which blister pack members 40 and 41 are folded about during closing and opening of the package. This hinge axis is set, however, by precut slits 420. In sum, elongated groove 42 provides for good flexibility of the hinged connection while precut slits 420 determine the hinge axis which blister pack members 40,41 are folded about during opening and closing the package. FIG. 14 shows a side view of blister pack 4 illustrating the location of elongated groove 42 while FIG. 15 shows detail XV of FIG. 14 (i.e. the cross-sectional shape of elongated groove 42) in an enlarged view.

It is to be noted that although blister pack 4 is particularly suitable when used as inner package of the package according to the instant invention, it is also possible to use blister pack 4 without any outer package at all. In this case, however, suitable engagement means may be provided at blister pack 4 so that blister pack members 40,41 can be locked in a folded position in which the two lid foils (aluminum foils) come to lie one above the other. This foil-on-foil state of blister pack 4 (without an outer package) also provides viable protection against accidental damage to the lid foil without the need of any outer package. Engagement means suitable for this purpose are known in the art and may comprise straps which may be arranged at those edges of the blister pack 4 running parallel to elongated groove 42, and in a manner such that they are able to overlap and lock blister pack members 40,41 in the folded position. Alternatively, the engagement means may comprise a projection in one of these end regions and a corresponding recess in the other end region of blister pack 4, so that the protrusion may be pressed into the recess to provide a frictional fit in order to lock blister pack members 40,41 in the folded position, as this is well-known in the art.

While the invention has been disclosed with the aid of specific variants, it is to be understood that numerous changes and modifications can be made without departing from the spirit and scope of the invention, which is defined by the appended claims.

The invention claimed is:

1. A package for goods comprising a closeable and openable outer package as well as an inner package carrying the goods, characterized in that the outer package comprises two comparatively rigid outer package members which are connected to one another via a flexible web portion, each of the two outer package members comprising a base panel and two opposite side wall panels, wherein at least one of the side wall panels of each of the two outer package members is provided with a fold so as to form an attachment portion extending in a direction towards the opposite side wall panel of the respective outer package member, and wherein the inner package comprises panel members or blister pack members carrying the goods on one of the two sides thereof, the panel members or blister pack members of the inner package comprising an edge portion which is attached to the attachment portion of the respective outer package member such, that in a closed state of the package the goods carried by the respective panel member or blister pack member are facing towards the base panel of the respective outer package member and the two outer package members are folded towards each other via the flexible web portion so as to lie one above the other, whereas in an open state of the package the two outer package members are unfolded and the panel members or blister pack members carrying the goods can be accessed by folding the attachment portion with the attached panel member or blister pack member in a direction away from the opposite side wall panel thus exposing the goods carried by the panel or blister pack.

2. A package according to claim 1, wherein the outer package members further comprise front wall panels having an engagement member having a first part associated with a first of the outer package members and a second part associated with the other of the second outer package members, said first part and said second part interacting to reversibly lock the outer package members in a closed position.

3. A package according to claim 1, wherein the inner package comprises two panel members or blister pack members which are connected by a flexible fold, and wherein the edge portions of the panel members or blister pack members are attached to the attachment portions of the outer package members with the flexible web portion between the outer package members being bulged, so that during unfolding of the outer package members the two panel members or blister pack members are unfolded and additionally flipped to a position where they expose the goods.

4. A package according to claim 3, wherein the flexible fold connecting the two panel members or blister pack members is formed by an elongated groove that extends over a substantial part of the width of the connected panel members or blister pack members, and wherein slits are arranged in axial alignment with the elongated groove, with one slit extending from the respective edge of the panel member or blister pack member towards the elongated groove so as to define the hinge axis which the connected panel members or blister pack members are folded about.

5. A package according to claim 1, wherein the side wall panels of the outer package members opposite the side wall panels having the attachment portions are provided with a wall extension which is triangularly folded so as to angularly extend towards the base panel, the wall extension then being again folded to as to run parallel to the base panel.

6. A package according to claim 5, wherein the wall extension is provided with a flap.

7. A package according to claim 2, wherein the inner package comprises two panel members or blister pack members which are connected by a flexible fold, and wherein the edge portions of the panel members or blister pack members are attached to the attachment portions of the outer package members with the flexible web portion between the outer package members being bulged, so that during unfolding of the outer package members the two panel members or blister pack members are unfolded and additionally flipped to a position where they expose the goods.

8. A package according to claim 2, wherein the side wall panels of the outer package members opposite the side wall panels having the attachment portions are provided with a wall extension which is triangularly folded so as to angularly extend towards the base panel, the wall extension then being again folded to as to run parallel to the base panel.

9. A package according to claim 3, wherein the side wall panels of the outer package members opposite the side wall panels having the attachment portions are provided with a wall extension which is triangularly folded so as to angularly extend towards the base panel, the wall extension then being again folded to as to run parallel to the base panel.

10. A package according to claim 4, wherein the side wall panels of the outer package members opposite the side wall panels having the attachment portions are provided with a wall extension which is triangularly folded so as to angularly extend towards the base panel, the wall extension then being again folded to as to run parallel to the base panel.

* * * * *